United States Patent [19]

Spencer et al.

[11] 3,949,533

[45] Apr. 13, 1976

[54] MODULAR CEILING SYSTEM

[75] Inventors: William H. Spencer, La Canada; John O. Dorius, Hacienda Heights, both of Calif.; James D. Brown, Grants Pass, Oreg.

[73] Assignee: Trend Ceiling Systems, Co., Los Angeles, Calif.

[22] Filed: Jan. 27, 1972

[21] Appl. No.: 221,143

[52] U.S. Cl. ..... 52/758 A; 52/667

[51] Int. Cl.[2] ..... F16B 21/08; E04B 1/38

[58] Field of Search ..... 52/710, 28, 667, 666, 493, 52/144, 488, 476, 729, 484, 485, 475, 668, 669, 656, 758 A

[56] References Cited

UNITED STATES PATENTS

| | | | |
|---|---|---|---|
| 1,007,511 | 10/1911 | Young | 52/710 |
| 1,561,126 | 11/1925 | Timm | 52/710 |
| 3,023,865 | 3/1962 | Brandstetter | 52/484 |
| 3,336,708 | 8/1967 | Rambelle | 52/729 |
| 3,367,695 | 2/1968 | Haertel | 287/189.36 A |
| 3,606,417 | 9/1971 | Rousey | 287/189.36 A |
| 3,619,960 | 11/1971 | Thompsen | 52/484 |

FOREIGN PATENTS OR APPLICATIONS

| | | | |
|---|---|---|---|
| 1,281,949 | 12/1961 | France | 52/495 |
| 1,013,217 | 12/1965 | United Kingdom | 52/710 |

*Primary Examiner*—John E. Murtagh
*Attorney, Agent, or Firm*—Sellers and Brace

[57] ABSTRACT

A modular ceiling system utilizing a plurality of stringers interlocked with one another to provide a rectangularly celled, high strength, non-warping suspended ceiling grid assembly. The T-shaped extruded aluminum stringer employed in the grid assembly has a channel-shaped T-head designed to support acoustical ceiling tiles flush with the lower edge of the stringers. The main stringers are arranged parallel to one another and interlocked to secondary stringers to provide a grid of four sided cells. Part of the secondary stringers have the same length as one side of a single cell and others are of double that length. The double length secondary stringers are constructed to have a snug snap-lock joint with the main stringers whereas the single length secondary stringers have a snug, non-locking fit between the mid-portions of the double length stringers. A lighting unit occupies a pair of adjacent grid cells and is installable selectively with its length extending either lengthwise or transversely of the main stringers and includes provision for supplying and exhausting ventilating air. The downwardly opening channels of the T-head portions of all stringers serve multiple functions, including an anchorage for various suspended objects, room divider partitions, etc.

15 Claims, 14 Drawing Figures

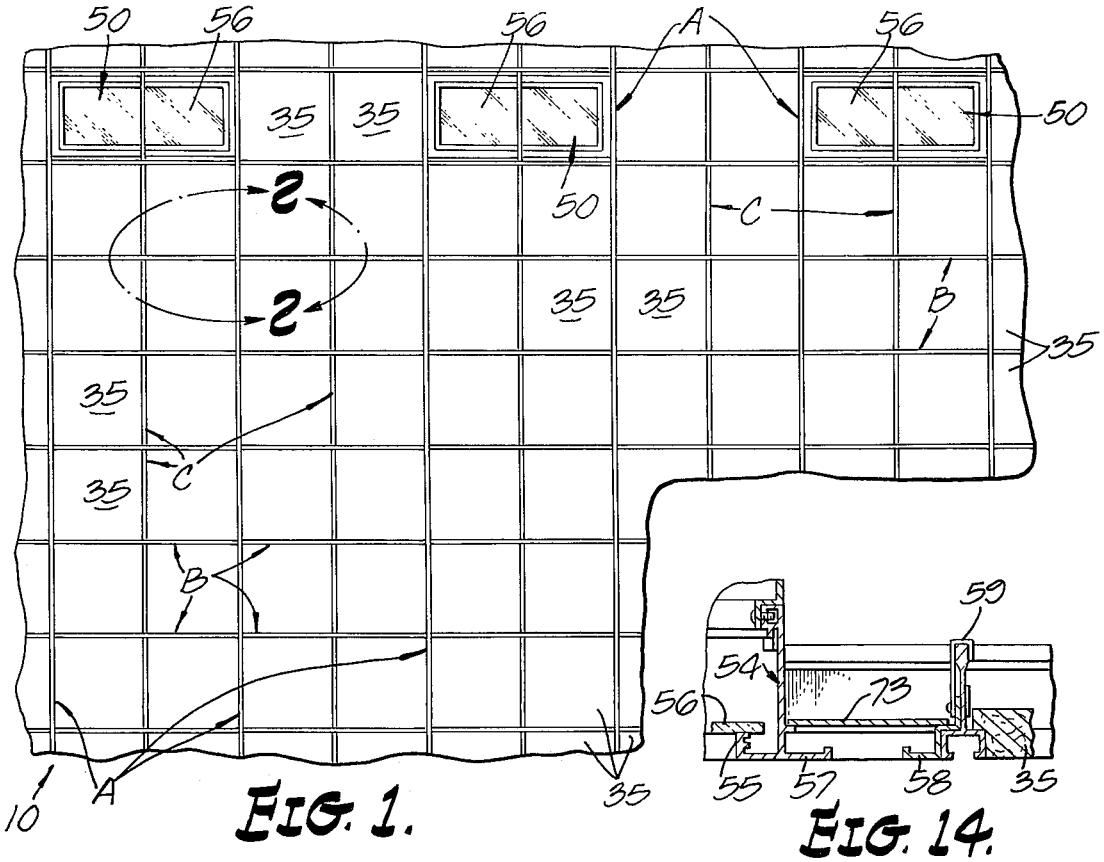
FIG. 1.
FIG. 14.
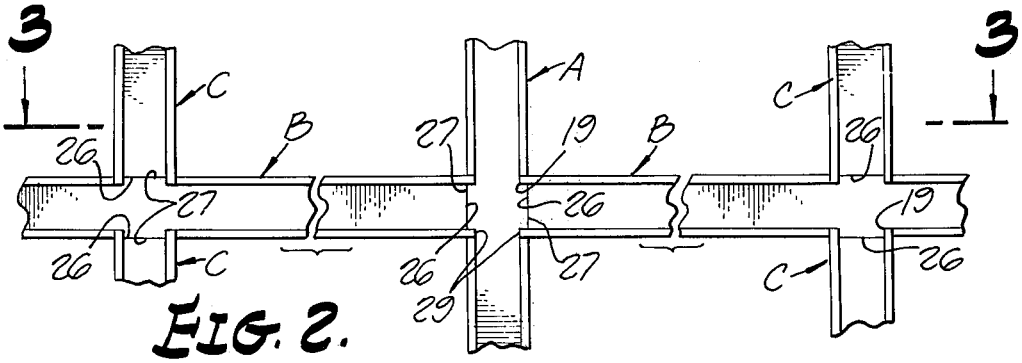
FIG. 2.
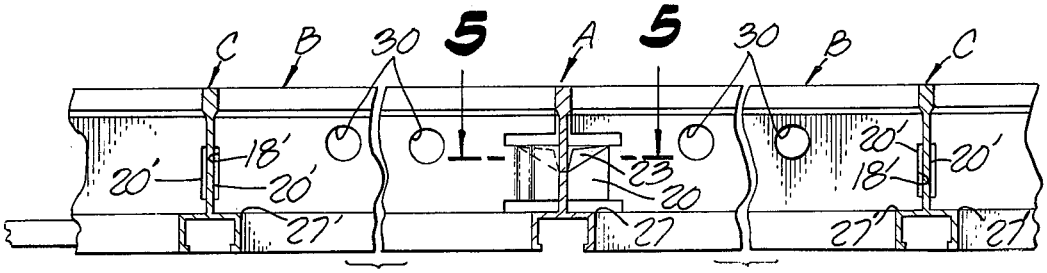
FIG. 3.

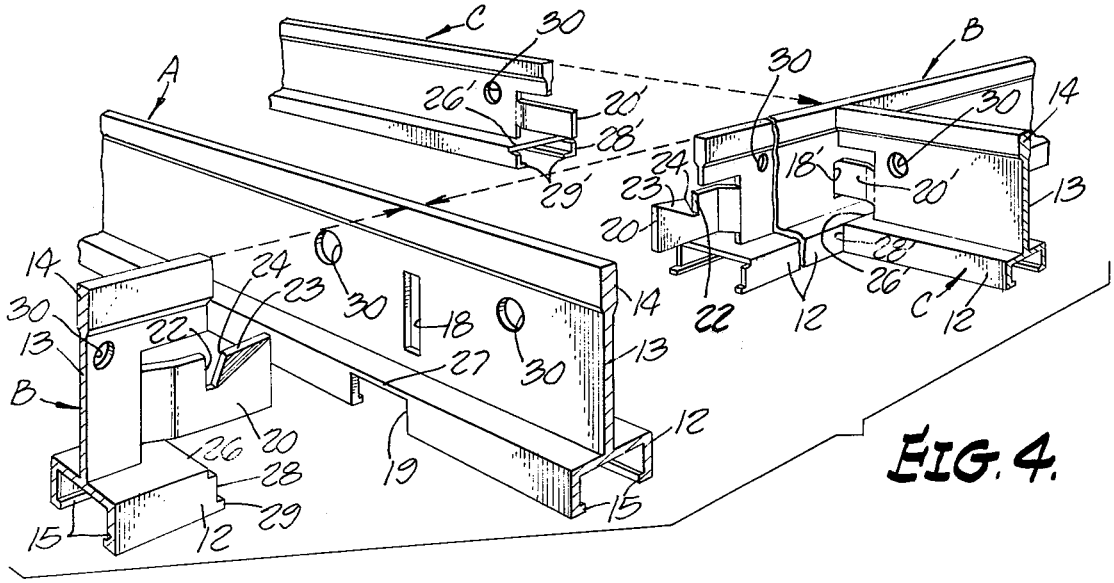
FIG. 4.
FIG. 5.
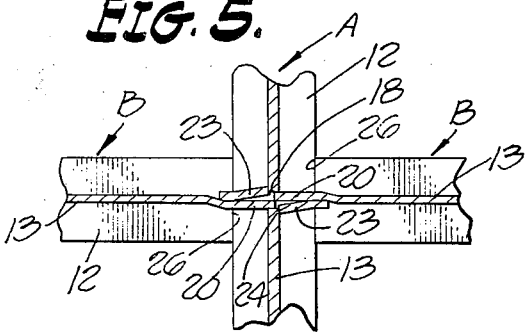
FIG. 8.
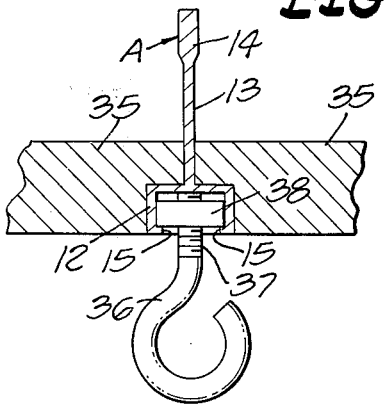
FIG. 9.
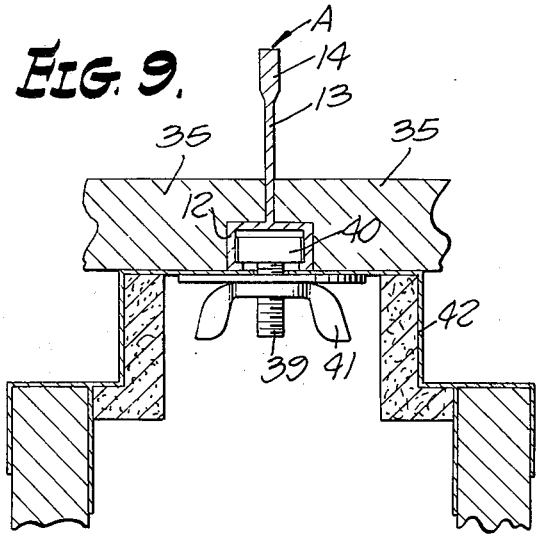
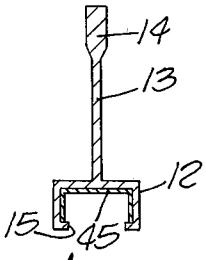
FIG. 6.
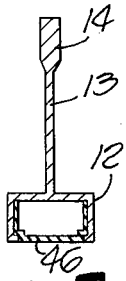
FIG. 7.

MODULAR CEILING SYSTEM

This invention relates to suspended ceiling systems and more particularly to an improved grid-forming stringer and to a snap-lock joint for holding components thereof rigidly assembled to provide a highly versatile rigid, non-warping grid assembly adapted to support acoustical ceiling tiles and a combined illuminating and ventilating unit in a unique manner.

A wide variety of suspended ceiling systems have been proposed heretofore utilizing many different techniques for supporting acoustical tile as well as ventilating and illuminating devices. However, these various proposals are subject to serious disadvantages and shortcomings avoided by the present invention. It has been customary to employ long stringer components arranged in criss-cross fashion and suspended at a desirable level with provision for supporting the ceiling tile proper. It has been common practice to utilize a gridwork having stringers formed from extruded or sheet metal and connected together at intersections by various expedients. Stringers of this type are easily deformed after, prior to, or as an incident to their installation, with the result that the ceiling tiles do not interfit properly therewith or are supported in a distorted, non-level or non-uniform manner. But even if properly installed initially, such ceiling structures warp, buckle or become distorted by hazards normally encountered in the use of the facility or by careless unskilled technicians while servicing, redecorating or gaining access to the overhead area for some reason.

There is also need from time to time to subdivide the working space below the ceiling to suit changing needs for the use of the building. Such changes often involve rearrangement of wall divider partitions with a related need for rearranging and re-orienting the lighting and ventilating facilities. Prior suspended ceiling assemblies either lack these capabilities or possess them only to a limited degree. Prior suspended ceiling systems also lack proper and desirable provision for anchoring room dividers in any selected position in the system or to hang items, curtains and the like, from any selected point in the grid network. Additionally prior ceiling constructions necessitate anchoring the partitions and the like to the ceiling in a manner causing unsightly defacement if the partitions are subsequently moved.

It is therefore a primary object of the present invention to provide a greatly improved ceiling avoiding the foregoing and other shortcomings. This is accomplished employing a basically new stringer configuration formed of thick walled, extruded aluminum stock. This stringer is characterized as being of T-shape in cross-section with the T-head portion channeled and opening downwardly with inturned lips lying flush with the lower surface of the completed ceiling and providing an anchorage for suspended items as well as for wall dividers and the like. The main stringers extend lengthwise of the space to be covered and are connected by secondary stringers including double length stringers have a unique connection at each end with a pair of main stringers, and having their mid-length portions connected through similarly unique but non-locking joints by single length stringers. In the unique joint between a first stringer and two secondary stringers abutting the opposite sides thereof, the first stringer has opposed notches in the sidewalls of its channel shaped T-head sized and shaped to have a snug nesting fit with the notched ends of the T-heads of the secondary stringers. Long tongues formed in the T-stems of the cross stringers lie in side-by-side relation through a rectangular opening in the T-stem of the first stringer. This design provides an exceptional strong joint wherein the three stringers are precisely located and firmly anchored against bending, twisting or buckling. To hold the stringers assembled suitable fasteners are employed. For this purpose certain of the joint tongues preferably include snap tabs which engage and lock the stringers assembled. The tongues of stringers interconnecting the midportions of stringers previously locked assembled need not be equipped with fasteners or locking tabs since they have a length such that the ends of their T-heads firmly abut the notched edges of the T-heads of the stringers being jointed together.

The resulting grid work comprises a multiplicity of rectangular cells of unusual strength and ability to resist twisting, bending, buckling and distortion out of the grid plane. The acoustical tile plaques are supported on the bottom portions of the channel-shaped T-heads with their lower surfaces lying flush with the lower edges of the stringers.

Lighting and ventilation is provided by a combination unit typically occupying two complete grid cells with its mid-width straddling either a main or a secondary stringer. Accordingly, the lighting and ventilating unit can be readily moved to occupy a position either parallel or at right angles to the main stringers. Also these units can occupy any pair of grid cells simply by shifting the tiles to cover the previous lighting position as the unit is transferred to the selected new position.

Accordingly, it is a primary object of the present invention to provide an improved stringer member for a suspended ceiling system.

Another object of the invention is the provision of an extruded aluminum stringer for use in a suspended ceiling grid assembly and featuring a channel-shaped T-head with inturned lips providing an anchorage for any of various underlying facilities.

Another object of the invention is the provision of an improved high strength precision joint at the junction of crossing stringers of a suspended ceiling grid assembly highly resilient to distortion, bending, twisting, buckling, warping and the like deformities.

Another object of the invention is the provision of an improved joint between the stringers of a ceiling grid assembly wherein all stringers are held rigidly and firmly internested at points of intersection with abutting surfaces mutually cooperating to resist relative movement either within or out of the plane of the grid.

Another object of the invention is the provision of a rigid, non-distortable ceiling grid assembly comprising a plurality of main stringers rigidly interlocked by an H-shaped sub-unit.

Another object of the invention is the provision of a ceiling grid assembly comprising a plurality of parallel main stringers interlocked by a multiplicity of H-shaped sub-units.

Another object of the invention is the provision of a modular, suspended ceiling grid assembly subdivided into cells by extruded T-shaped stringers held locked together by snap action joints.

Another object of the invention is the provision of a suspended ceiling grid assembly comprising T-shaped stringers having complementally shaped interfitting T-heads and T-stems which automatically interlock upon reaching their fully assembled positions.

Another object of the invention is the provision of a suspended ceiling grid assembly of interlocked cells, any aligned pair of which can be selectively used to support an illuminating unit readily convertible to additional use for ventilating purposes.

Another object of the invention is the provision of a combined ventilating and illuminating unit designed to straddle a ceiling grid member and to overlie and occupy any adjacent aligned pair of grid cells and readily shiftable at any time to any other aligned pair of cells in the grid assembly.

Another object of the invention is the provision of a suspended ceiling grid assembly including an H-shaped sub-assembly of stringer elements, the opposite ends of which are designed to have an interlocking snap fit with openings through the T-stem portions of a pair of main stringers.

These and other more specific objects will appear upon reading the following specification and claims and upon considering in connection therewith the attached drawing to which they relate.

Referring now to the drawing in which a preferred embodiment of the invention is illustrated:

FIG. 1 is a fragmentary, bottom plan view of a fully assembled ceiling embodying one preferred embodiment of the invention;

FIG. 2 is a fragmentary plan view on an enlarged scale taken in area 2—2 on FIG. 1 crosswise of one main stringer and adjacent secondary stringers;

FIG. 3 is a fragmentary cross-sectional view taken along line 3—3 on FIG. 2 and illustrating centrally thereof a snap-in, locking joint and, to either side thereof, a pair of non-locking joints;

FIG. 4 is an exploded view of a snap-in locking joint and of a non-locking joint, both in the process of being assembled;

FIG. 5 is a cross-sectional view of a snap-in joint taken along line 5—5 on FIG. 3;

FIG. 6 is a cross-sectional view through a stringer having a type of decorative insert assembled in the T-head thereof;

FIG. 7 is a view similar to FIG. 6 but showing an laternate type of decorative insert assembled to to the T-head;

FIG. 8 is a cross-sectional view through a stringer showing a suspension hook for supporting a curtain or other object from the grid assembly;

FIG. 9 is a cross-sectional view similar to FIG. 8 but showing a stringer T-head in use to anchor a wall divider partition to the grid assembly;

FIG. 14 is a cross-sectional view similar to FIG. 15 but showing a closure plate installed in lieu of the exhaust air fitting.

Figure 10:
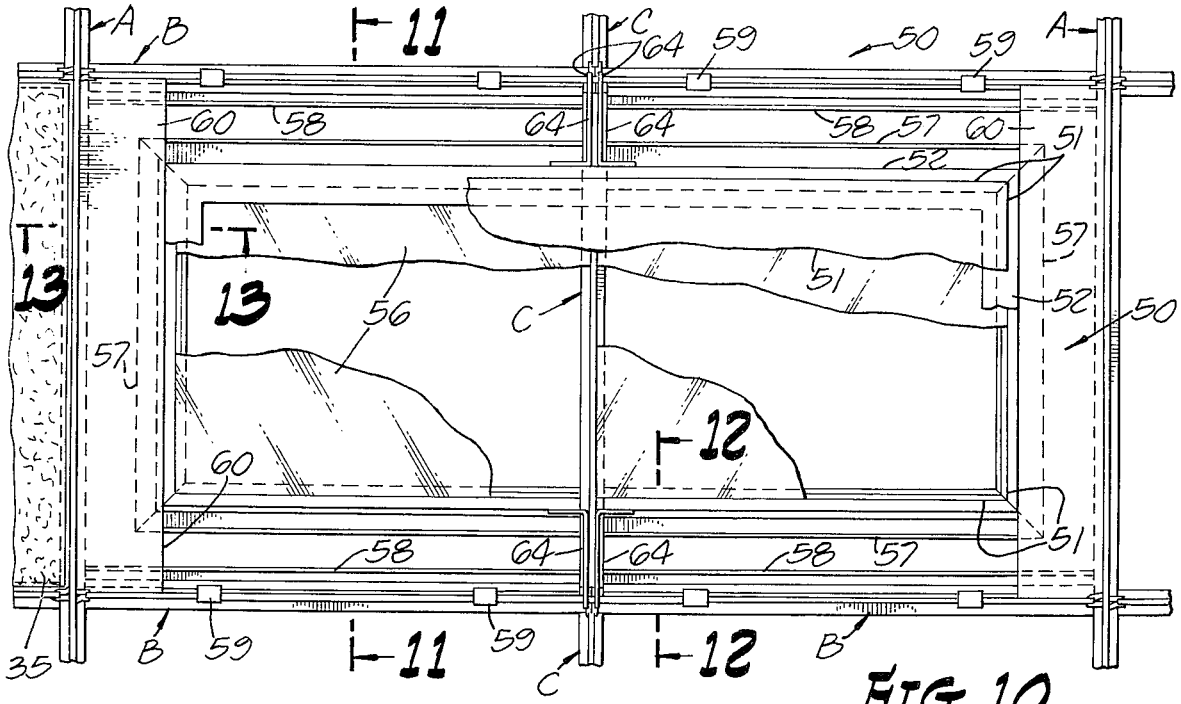
FIG. 10 is a top plan view of the grid assembly looking downwardly onto a pair of grid cells having a lighting unit installed therein with parts of the lighting unit broken away to show structural details.

Referring initially more particularly to FIGS. 1, 2 and 3, there is shown an illustrative embodiment of the invention suspended ceiling, designated generally 10, featuring a rigid grid assembly formed by a plurality of parallel stringers A, A arranged parallel to one another and spaced two grid cells apart. These main stringers are interlocked to double-length pairs of secondary stringers B, B. The mid-portions of stringers B, B are interconnected by single length secondary stringers C, C. An adjacent pair of double stringers B, B and the intervening single stringer C comprise an H-shaped sub-unit which forms a pair of square grid cells when the ends of its legs are interlocked with a pair of main stringers A, A.

It will be understood that all stringers A, B and C are identical and extruded from aluminum. Each is of T-shaped and differ from one another only in length and in the manner in which their ends are formed for interlocking assembly to form a rigid grid of square cells although they may be of rectangular configuration if desired. Details of the grid assembly are best shown in FIG. 4 wherein the stringer A will be seen to have a channel-shaped T-head 12 having the mid portion of its bottom integral with a wide T-stem 13 thickened along its free edge 14 to stiffen it. The free edges of the channel-shaped T-head have inturned lips 15, 15 serving various functions and purposes as will be explained more fully presently.

The snap-in lock joint between the stem portions of stringers A and the double length cross stringers B will now be described with the aid of FIGS. 4 and 5. For this purpose, T-stems 13 of the main stringers are formed with rectangular openings 18 spaced apart by the length of one side of the square grid cells and having a width double the thickness of the central portion of T-stems 13. The two sidewalls of channel shaped T-head 12 are also provided with square cutouts or notches 19, 19 having a width equal to the transverse dimension of the T-head and a depth flush with the interior bottom wall of the T-head. It will therefore be appreciated that notches 18 are sized to receive specially shaped ends of the sidewalls of the T-head 12 of the double length stringers B.

Each end of stringers B is shaped as shown in FIG. 4. Thus the opposite ends of T-stems 13 are notched lengthwise thereof to form a long tongue 20 projecting beyond the portions of the T-stem to either side thereof. One edge of tongue 20 is deeply notched transversely thereof as is indicated at 22, and the triangular-shaped portion of the free end of the tongue contiguous to notch 22 is bent out of the plane of the notch to form a resilient locking tab 23. Corner 24 of this tab is positioned to engage the remote lateral rim edge of opening 18 of main stringers A as a pair of the tongues on an associated pair of stringers B, B are assembled in side-by-side relation through openings 18 of the main stringers until their T-heads are fully assembled within notches 19. The fully assembled interlocked condition of stringers A and B is best illustrated in FIG. 5, it being noted that corners 24 of the tabs 23 are there shown as engaged with the rim edges at the opposite ends of opening 18. It will also be observed from FIG. 5 that tongues 20 at the opposite ends of the double length stringers B are offset in opposite directions by one-half of the thickness of the T-stem. It will also be understood that the width of opening 18 is double the thickness of tongues 20 with the result that these tongues have a snug sliding fit with the edges of the opening 18.

The opposite ends of the T-head portion of stringers B are punched or blanked to have the shape illustrated in FIG. 4. Thus, the bottom of the T-head is notched so that edge 26 seats flush against corner edge 27 (FIG. 3) of the main stringer T-head. The end edge 28 of the sidewalls of the T-head are dimensioned to lie flush against the interior surface of the T-head in the assembled portion of the joint. Likewise end edge 29 lies flush with the inner edge of lip 15 of stringer A.

Details of the non-locking joint between the single length stringer C and the mid portion of the double length stringers B are illustrated in FIGS. 3 and 4. It will be understood that the ends of stringers C are notched and provided with tongues exactly like those described above with the exception that tongues 20′ are not notched crosswise of one lateral edge nor are they provided with a locking tab 23. However tongues 20′, at the opposite ends of the stringers, are offset one-half the thickness of the T-stem so as to lie side-by-side and snugly within the elongated openings 18′ in the mid-length of stringers B. It will be appreciated that the joint between stringers B and C have a snug sliding fit but do not positively interlock with one another as do the joints between stringers A and B. However, owing to the fact that stringers A and B are positively interlocked, stringers C are held in aligned assembled relation substantially without play between any of the abutting surfaces and are substantially as effective in preventing twisting, bending, flexing, warping and buckling because of the snug fit of the parts and the action of the positively interlocked joints to either side thereof.

The assembly of the grid is accomplished by suspending main stringers A in parallel arrangement by the use of suitable suspension wires having their ends extending through openings 30, 30 (FIG. 3) located at frequent intervals along the length of their T-stems. The assemblers then proceed to install the double length transverse stringers B, B between the main stringers by inserting tongues 20, 20 from the opposite ends of openings 18. Stringers B are pressed firmly toward one another from the opposite sides of the T-stem of stringers A until each of the resilient locking tabs 23 snap into locking position. Owing to the camming action provided by the inclined upper edge of tabs 23 and the resiliency of the material, these tabs are flexed substantially into the plane of tongues 20 as they are being forced into their assembled positions and then snap back into their former positions as tongues 20 reach a fully assembled position. In other words, once the shouldered edge surface 26 of the T-head abuts the edge of the web portion of the T-head, tabs 23 are free to resume their deflected locking position shown in FIGS. 4 and 5.

The double length stringers B having been assembled, the installer then proceeds to install the single length stringers C between the mid portions of stringers B. The tongue at one end is inserted into its adjacent opening 18′ of stringer B following which the similar tongue at the other end is inserted in the similar opening 18′ of the adjacent stringer B by bowing one or both of the stringers B away from one another sufficiently for insertion of the second one of tongues 20′. In this manner the installer proceeds to install the C stringers one by one, bowing stringers B away from one another as necessary to effect assembly of the joints between tongues 20′ and openings 18′. This having been accomplished, a very rigid grid assembly 10 is provided, with all stringers supported in a horizontal plane from suspension wires, not shown, but having their lower ends hooked through openings 30, 30 in the various stringers.

It will be understood that acoustical tile or ceiling plaques 35 have their lower rim edges rabbeted as best shown in FIGS. 8 and 9 so as to conform with the stringer T-head 12. These rabbeted edges are so dimensioned that the lower surface of the plaques or tiles lies flush with the lower surfaces of the stringer T-heads. Sufficient clearance is left between the edges of the plaques and the stringers to permit the plaques to be inserted edgewise from below to a level above the T-heads and then lowered flatwise into their installed position in accordance with well known practice.

Referring to FIG. 8, it will be understood that a simple accessory installable in the channels of the T-head can be utilized to suspend curtains, charts, film projection screens and a wide variety of items from any selected point in the ceiling. One of the many accessories and anchorages for this purpose comprises an eyebolt 36 having its threaded shank 37 mating with a nut 38 having a loose sliding fit along the T-head with its edges resting on the inturned lips 15. Nut 38 can be inserted at any grid joint by appropriate manipulation of the nut and then slid to any selected position along the stringer. At the selected location the eye bolt is simply tightened until its inner end abuts the bottom of the T-head to force the nut into tight engagement with the lips.

Referring to FIG. 9, a variant type of the anchorage is shown as comprising a bolt 39 having its head 40 freely slidable along the interior of any stringer T-head and a wing nut 41 assembled over its threaded shank. This type of anchorage provides a convenient mode of anchoring a wall partition header 42 to any selected stringer or group of stringers of the grid system. This provides a simple, highly versatile means of subdividing the space below the ceiling into any of a large variety of sizes and shapes of compartments.

FIGS. 6 and 7 are illustrative of two different types of decorative inserts which can be utilized as readily changeable covers or liners for the exposed channel surfaces of the T-head. Insert 45 comprises a continuous length of thin-walled, semi-rigid plastic material of any desired color or finish readily inserted from one end of the T-head with either edge of its sidewalls resting on the inturned lips 15. Thus it will be understood that it can be installed as shown or inverted so that its bottom rests on lips 15. An alternate type of insert 46 is shown in FIG. 7. This insert is contoured for insertion with its web portion lying flush with the free edges of the T-head.

The combined lighting and ventilating facility, designated generally 50, will now be described with particular reference to FIGS. 1 and 10 to 14. As herein illustrated by way of example, unit 50 occupies a pair of adjacent grid cells with its mid portion suitably channeled to straddle a stringer, such as stringer C common to a pair of adjacent grid cells. It will be understood that unit 50 may be installed with this channel straddling any one of stringers A, B or C.

The main body of unit 50 comprises a rectangular downwardly opening casing 51 supporting several flourescent light bulbs 52. Secured to the lower edge of casing 51 is an adapter frame 52 secured, as by self-threading screws 53, to a channel extending along the upper inner rim of a frame 54. This frame is fabricated from extruded aluminum strips having the configuration clearly shown in FIGS. 11 to 14.

The lower rim of frame 54 is generally T-shaped in cross section and includes an inner edge 55 terminating at a level coplanar with the upwardly facing bottom portion of the stringer T-heads 12. This ledge supports the light-transmitting lens or panel 56 which merely rests thereon by gravity. Lens 56 is so proportioned that it can be removed in well known manner by tilting it through an appropriate angle. The outwardly projecting ledge 57 of frame 54 forms the inner edge of a ventilating passageway along either longer side of the lighting unit. The other edges of the ventilating passages are formed by extruded strips 58 secured to hanger strips 59 engaged over the upper edge of the adjacent one of the stringers. It will be understood that strips 58 are shaped to rest against the exterior edge of the T-head of the stringer with its bottom portion lying flush with the lower surface of the ceiling and the adjacent lower surface of portion 57. As will be apparent from the foregoing, strips 58 extend along either longitudinal side of unit 50 and cooperate with edges 57 in providing either or both air inlet and air outlet passages.

As is best known in FIG. 10, lamp casing 51 terminates inwardly from main stringers A, A and this space is closed by a pair of channel-shaped strips 60 (FIGS. 10, 13) secured, as by screws 61, to frame members 54 along either transverse end of the lighting unit. The outer edges 62 of members 60 rest on the T-head of the adjacent stringer and provide a major support for unit 50 on the grid system. Cooperating with members 60 in supporting unit 50 are pairs of hook-shaped hanger brackets 64 (FIGS. 10, 12) projecting from the mid portion of the unit and fixed to the sides of members 54. These hangers engage over the upper edges of the stringers.

Incoming fresh air is supplied through the ceiling by flexible ducts 65 (FIG. 11) opening into plenum chambers 66 (FIG. 11) having outlets opening downwardly with their edges seated against the interior surfaces of ledge 57 and 58 along one side of unit 50. Outlet 67 will be understood as having a portion straddling stringer C traversing the midlength of the outlet. It will also be understood that the outlet opening proper is regulatable by any suitable adjustable flow director such as the pivoting vane indicated by the dot and dash line at 69.

Figure 11:
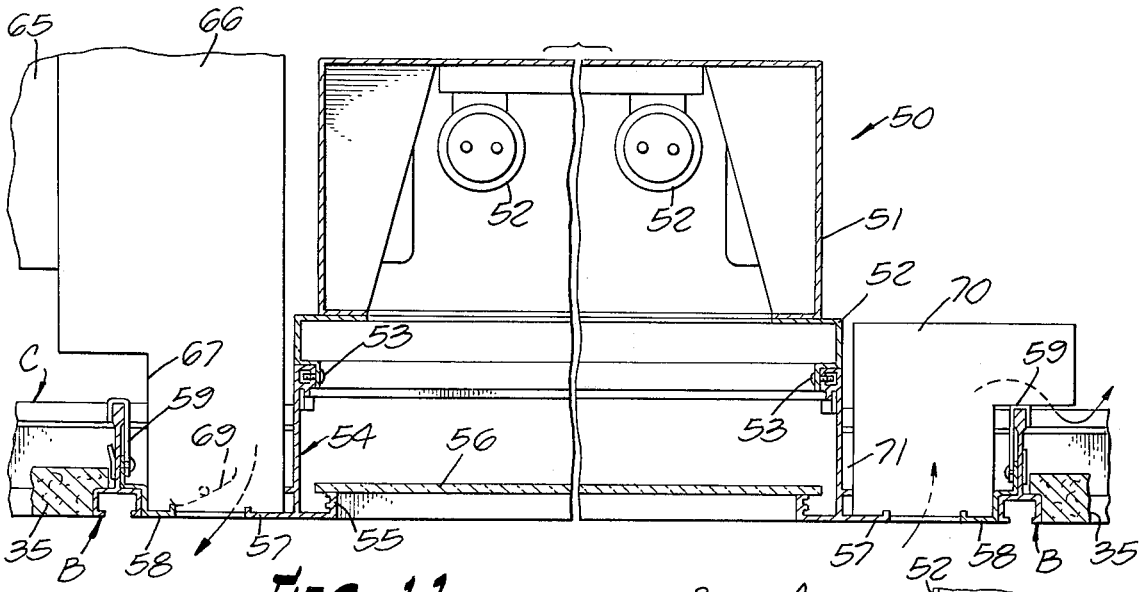
FIG. 11 is a cross-sectional view taken along line 11—11 on FIG. 10 showing, in addition to the lighting unit, a fresh air supply chamber installed along one side of the lighting unit and an exhaust air chamber installed along the other side thereof.
Figure 13:
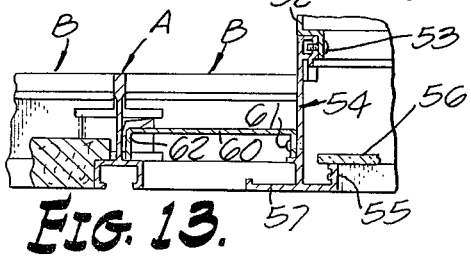
FIG. 13 is a cross-sectional view taken along line 13—13 on FIG. 10.
Figure 12:
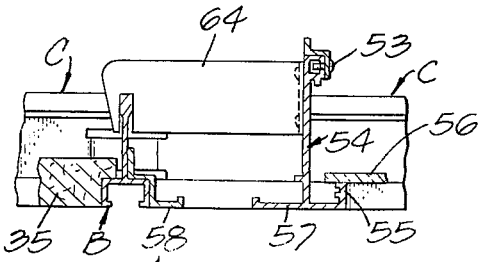
FIG. 12 is a cross-sectional view taken along line 12—12 on FIG. 10.

An exhaust air outlet fixture 70 (FIG. 11) has its inlet end 71 similarly resting on the interior surfaces of ledges 57, 58 with its outlet overlying the adjacent stringer B in the manner shown in FIG. 11. Some of the units 50 may not require an air outlet fitting 70 and, in this case, unit 70 is omitted and in its place a plate 73 (FIG. 14) is inserted with its lateral edges resting on the flanges of members 54 and 58.

From the foregoing it will be evident that the combined lighting and ventilating unit 50 together with the air fittings 66, 70 can be readily moved to occupy any pair of adjacent grid spaces. This is done by first removing the acoustical tile 35 from a selected pair of grid cells and then equipping the longer side of these cells with sets of members 58, 58 with their hanger hooks 59 engaged over the upper edges of a pair of stringers. Unit 50 is then lifted from its former location and lowered into the newly selected pair of grid cells until plate 60 extending across its opposite ends and its hanger hooks 64 come to rest against the supporting surfaces of the grid assembly. Air chambers 66, 70 are then returned to their former respective assembly positions. The lighting unit and the air ventilating system is now ready for operation in its new location without need for the services of an electrician or other skilled labor.

While the particular modular ceiling system herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. A stringer for use in forming a suspended ceiling grid assembly comprising a continuous lightweight aluminum extrusion of general T-shape in cross section and characterized by a channel shaped T-head having an open side facing away from and lying in a plane normal to the T-stem portion thereof, said T-stem portion having a rectangular opening therethrough with its longer dimension extending normal to the web of said channel shaped T-head and its shorter dimension corresponding to the thickness of said T-stem portion, and one sidewall of said T-head being notched opposite the adjacent end of said rectangular opening to a depth flush with the interior bottom surface of the web of said T-head and to a width corresponding to the distance between the exterior sidewall surfaces of said T-head.

2. A stringer as defined in claim 1 characterized in that both sidewalls of said T-head are identically notched in direct alignment with one another crosswise of said T-head.

3. A stringer as defined in claim 2 characterized in that said rectangular opening has a shorter dimension corresponding to double the thickness of said T-stem portion.

4. A stringer as defined in claim 3 characterized in the provision of a plurality of pairs of aligned notches and an associated rectangular opening at spaced intervals along said stringer and identical to one another.

5. A stringer as defined in claim 3 characterized in that a bisector plane longitudinally of said rectangular opening bisects each of said aligned notches.

6. A stringer as defined in claim 1 characterized in the edges of the sidewalls of said T-head include flanges projecting inwardly toward one another.

7. A stringer as defined in claim 6 characterized in that the outer surfaces of said flanges are flush with the outer edges of said sidewall and lie in a common plane normal to the plane of said T-stem.

8. A stringer as defined in claim 6 characterized in the provision of an anchor member having a threaded shank fitting loosely between the adjacent edges of said flanges and having crosspiece means on one end thereof sized for insertion into said T-head through one of said notches to rest astride and be supported on said inwardly projecting flanges.

9. A stringer as defined in claim 8 characterized in that said crosspieceon said threaded shank is a threaded nut held against rotation by engaging the interior sidewalls of said T-head, and the inner end of said threaded shank being rotatable into pressure contact with the interior bottom surface of said T-head thereby to clamp said nut firmly and immovably against said inwardly projecting flanges.

10. A stringer as defined in claim 1 characterized in that the outer free edge of said T-stem is substantially thicker than the remainder of said T-stem and effective to strengthen said T-stem and resist warping and buckling stresses when said stringer is under load.

11. A stringer as defined in claim 1 characterized in that one end of said T-stem includes an elongated locking tongue integral therewith projecting longitudinally beyond the end thereof and sized for insertion through and to project beyond a rectangular opening of a second stringer, and the adjacent end of said T-head being notched so that the web portion thereof is adapted to seat flush against the exterior edge of the web of the T-head of a second stringer extending crosswise thereof, the sidewalls of said T-head being adapted to lie flush against and across the adjacent edges of a notch in one sidewall of the T-head of said second stringer and which notch has the same width as said first mentioned T-head, and the end edge of said T-stem being adapted to bear flush against the juxtaposed side of the T-stem of said second stringer when assembled crosswise of the end of said first mentioned stringer.

12. A stringer as defined in claim 11 characterized in that said locking tongue includes a locking tab having an edge adapted to engage the face of the T-stem of said second stringer when inserted through a rectangular opening in the T-stem thereof and to lock the T-head of said first mentioned stringer rigidly and firmly assembled in the notch in the sidewall of the T-head of said second stringer.

13. A stringer as defined in claim 2 characterized in the provision of an elongated strip of thin walled semi-flexible material of channel shape in cross section sized for telescopic assembly with said T-head.

14. A stringer as defined in claim 13 characterized in that said channel shaped strip is formed of thin pastic composition of a desired color and selectively mountable within said T-head with its web flush against the interior bottom of said T-head and in a second position across the open side of said channel shaped T-head.

15. A stringer as defined in claim 1 characterized in that one end of the T-stem thereof includes a long tongue projecting longitudinally beyond the remainder of said stringer, and the end corner of said tongue remote from the T-head of said stringer being weakened at an angle to the length of said tongue thereby to facilitate bending a predetermined tab portion of said corner out of the plane of said tongue.

* * * * *